US009636883B2

(12) United States Patent
Nagano et al.

(10) Patent No.: US 9,636,883 B2
(45) Date of Patent: May 2, 2017

(54) APPARATUS FOR PRODUCING POUCH CONTAINER WITH SPOUT

(75) Inventors: Satoshi Nagano, Minoh (JP); Satoshi Nii, Sakai (JP); Daisuke Itami, Sakai (JP)

(73) Assignee: FUJI SEAL INTERNATIONAL, INC., Osaka-shi (JP)

( * ) Notice: Subject to any disclaimer, the term of this patent is extended or adjusted under 35 U.S.C. 154(b) by 574 days.

(21) Appl. No.: 12/537,583

(22) Filed: Aug. 7, 2009

(65) Prior Publication Data

US 2010/0022374 A1 Jan. 28, 2010

Related U.S. Application Data

(63) Continuation of application No. PCT/JP2007/000061, filed on Feb. 7, 2007.

(51) Int. Cl.
*B31B 49/04* (2006.01)
*B31B 37/00* (2006.01)
(Continued)

(52) U.S. Cl.
CPC ..... *B31B 37/00* (2013.01); *B31B 1/00* (2013.01); *B31B 19/84* (2013.01);
(Continued)

(58) Field of Classification Search
CPC B31B 37/00; B31B 1/00; B31B 19/84; B31B 2219/146; B31B 2219/269;
(Continued)

(56) References Cited

U.S. PATENT DOCUMENTS 3,200,557 A * 8/1965 Schwenk ..... 53/477
3,486,423 A * 12/1969 Mistarz ..... 493/164
(Continued)

FOREIGN PATENT DOCUMENTS

JP 9-030506 A 2/1997
JP 11-130091 A 5/1999

OTHER PUBLICATIONS

English translation to the JP11130091.*
International Search Report of PCT/JP2007/000061, mailing date of Mar. 6, 2007.

*Primary Examiner* — Sameh Tawfik
(74) *Attorney, Agent, or Firm* — Westerman, Hattori, Daniels & Adrian, LLP

(57) ABSTRACT

Score lines are formed on package material. A spout attachment hole is formed in a portion corresponding to a top gusset section of a pouch. A spout is attached to the spout attachment hole. A portion corresponding to a peripheral edge of the top gusset section of the pouch and a portion corresponding to a top edge of a body section of the pouch are heat-sealed, and the package material is cut in the width direction. Portions corresponding to side edges of the body section of the pouch are heat-sealed, and a portion corresponding to a peripheral edge of a bottom gusset section and a portion corresponding to a peripheral edge of a bottom end portion of the body section are heat-sealed. The heat-sealed portions formed at the portions corresponding to the side edges of the body section of the pouch are cut so a spouted pouch package is released.

22 Claims, 14 Drawing Sheets

(51) Int. Cl.
*B31B 19/84* (2006.01)
*B31B 1/00* (2006.01)

(52) U.S. Cl.
CPC ... *B31B 2219/146* (2013.01); *B31B 2219/269* (2013.01); *B31B 2219/9054* (2013.01); *B31B 2237/20* (2013.01); *B31B 2237/406* (2013.01); *B31B 2237/50* (2013.01)

(58) Field of Classification Search
CPC ..... B31B 2219/9054; B31B 2237/20; B31B 2237/406; B31B 2237/50
USPC ..... 493/195, 213, 394, 114, 87
See application file for complete search history.

(56) References Cited

U.S. PATENT DOCUMENTS

| | | | | | |
|---|---|---|---|---|---|
| 4,470,152 | A | * | 9/1984 | Blankenship | 383/37 |
| 4,572,422 | A | * | 2/1986 | Heuberger et al. | 229/117.3 |
| 4,685,148 | A | * | 8/1987 | Titchenal | 383/37 |
| 4,790,803 | A | * | 12/1988 | Roen et al. | 493/195 |
| 4,816,104 | A | * | 3/1989 | Benoit | 156/204 |
| 4,862,680 | A | * | 9/1989 | Krah | 53/575 |
| 4,946,431 | A | * | 8/1990 | Jensen | 493/195 |
| 5,069,385 | A | * | 12/1991 | Farber | 229/137 |
| 5,176,313 | A | * | 1/1993 | Curry et al. | 229/125.15 |
| 5,350,110 | A | * | 9/1994 | Will | 229/125.15 |
| 5,542,902 | A | * | 8/1996 | Richison et al. | 493/195 |
| 5,810,706 | A | * | 9/1998 | McDonald et al. | 493/212 |
| 6,832,464 | B2 | * | 12/2004 | Wilson et al. | 53/462 |
| 7,204,641 | B2 | * | 4/2007 | Stolmeier | 383/64 |

* cited by examiner

APPARATUS FOR PRODUCING POUCH CONTAINER WITH SPOUT

This application is a continuation of international application number PCT/JP2007/000061, filed on Feb. 7, 2007, entitled METHOD FOR PRODUCING POUCH CONTAINER WITH SPOUT AND APPRARATUS FOR PRODUCING POUCH CONTAINER WITH SPOUT.

TECHNICAL FIELD

The present invention relates to a method for manufacturing a spouted pouch package including a bottom gusset stand-up pouch and a spout attached to the pouch.

BACKGROUND OF THE INVENTION

An example of a spouted pouch package of this type is shown in FIGS. 13(*a*) to 13(*c*) and FIG. 14. As shown in the figures, the spouted pouch package SP includes a pouch P and a spout S. The pouch P includes a body section P1 which is heat-sealed at side edges thereof by a predetermined width, a top gusset section P2 provided on a top end portion of the body section P1, and a bottom gusset section P3 provided on a bottom end portion of the body section P1. The spout S is attached to the top gusset section P2 of the pouch P. In FIGS. 13(*a*) to 13(*c*) and FIG. 14, the shaded portions show the heat-sealed portions.

In the pouch P, the side edges of the top end portion of the body section P1 and the side edges of the bottom end portion of the body section P1 are not heat-sealed to each other. Instead, the peripheral edge of the top end portion of the body section P1 is bent so as to expand outward, and a peripheral edge portion of a top gusset sheet which forms the top gusset section P2 is heat-sealed to the top end portion of the body section P1 at the peripheral edge thereof. In addition, a peripheral edge portion of a bottom gusset sheet which forms the bottom gusset section P3 is heat-sealed to the bottom end portion of the body section P1 at the peripheral edge thereof such that the bottom gusset sheet is folded inward from the bottom side of the body section P1. In addition, the bottom gusset sheet has cut portions c at each side edge thereof, and the cut portions c at each side edge meet each other, as shown in FIG. 13(*b*), when the bottom gusset sheet is folded in half. The side edges of the bottom end portion of the body section P1 are partially heat-sealed to each other through the cut portions c.

The spout S includes a main body S1 and a flange portion S2 having a large diameter at the bottom end of the main body S1. The spout S is attached to the top gusset section P2 by inserting the main body S1 through an attachment hole formed in the top gusset section P2 from below and fixing the flange portion S2 to a portion of the top gusset section P2 around the attachment hole. See also Japanese Utility Model Registration No 2605636.

SUMMARY OF THE INVENTION

The spouted pouch package SP includes the pouch P having the top gusset section P2, as described above, and the shape of the spouted pouch package SP is close to that of, for example, a bottle container. Therefore, compared to a common bottom gusset spouted pouch package which does not have the top gusset section, the spouted pouch package SP is advantageous in that sufficient capacity can be provided without increasing the width or height of the pouch.

However, in the above-described spouted pouch package SP, the spout S is not attached to the pouch P at a heat-sealed edge thereof, but is attached to the top gusset section P2 at a central area thereof. Therefore, unlike a common spouted pouch package in which the spout is attached to the pouch at a heat-sealed edge thereof, it is not possible to use a method of heat-sealing the pouch while the spout is sandwiched at the heat-sealing edge of the pouch. Thus, there is a problem that the spouted pouch package SP cannot be efficiently mass-produced.

Accordingly, an object of the present invention is to provide a method for efficiently manufacturing a spouted pouch package including a spout attached to a top gusset section from a single sheet of package material by mass production.

To achieve the above-described object, a first aspect of the invention provides a method for manufacturing a spouted pouch package including a pouch and a spout, the pouch including a body section which is heat-sealed by a predetermined width at both side edges thereof, a top gusset section provided on a top end portion of the body section, and a bottom gusset section provided on a bottom end portion of the body section, the spout being attached to the top gusset section of the pouch. The method includes a step of folding long package material while conveying the package material, the package material being folded in a width direction of the package material such that a conveying direction in which the package material is conveyed is aligned with a width direction of the pouch; a step of attaching the spout to a portion of the folded package material which corresponds to the top gusset section; a step of heat-sealing a portion corresponding to a peripheral edge of the top gusset section and a portion corresponding to a top edge of the body section to each other by a predetermined width; a step of heat-sealing portions corresponding to side edges of the body section to each other with a predetermined width and heat-sealing a portion corresponding to a peripheral edge of the bottom gusset section and a portion corresponding to a peripheral edge of the bottom end portion of the body section to each other with a predetermined width; and a step of cutting the heat-sealed portions formed at the portions corresponding to the side edges of the body section, thereby releasing the spouted pouch package.

In addition, according to a second aspect of the invention, in the manufacturing method according to the first aspect of the invention, the package material is folded such that a side portion of the package material in the width direction of the package material forms a part of the peripheral edge of the top gusset section in the pouch.

In addition, according to a third aspect of the invention, in the manufacturing method according to the first or second aspect of the invention, in the process of heat-sealing the portions corresponding to the side edges of the body section to each other by the predetermined width, the portion of the package material corresponding to the top gusset section and a portion of the package material corresponding to the top edge of the body section are performed simultaneously.

In addition, according to a fourth aspect of the invention, the manufacturing method according to the first or second aspect of the invention further includes a step of locally heat-sealing portions corresponding to boundaries between the top edge and the side edges of the body section by clamping a part of the portion of the folded package material corresponding to the top gusset section and a part of a portion of the folded package material corresponding to the side edges of the body section together between sealing bars while a portion of the body section which corresponds to the top edge portion of the body section is heat-sealed to the peripheral edge of the top gusset section is folded downward, the locally heating-sealing step being performed after the portions corresponding to the side edges of the body section are heat-sealed to each other with the predetermined width and before the spouted pouch package is released by cutting the heat-sealed portions. In addition, according to a fifth aspect of the invention, after heat-sealing the portion corresponding to the top gusset section and the top edge of the body section, the heat-sealing of the portions corresponding to the side edges of the body section to each other is performed, while the portion of the body section which corresponds to the top edge portion of the body section heat-sealed to the peripheral edge of the top gusset section on one side of the body section is folded downward, such that the portions corresponding to boundaries between the top edge and the side edges of the body section are heat-sealed a second time.

As described above, in the method for manufacturing the spouted pouch package according to the first aspect of the, the bottom gusset spouted pouch package having the spout attached to the top gusset section can be efficiently mass-produced from a single sheet of package material.

In the case where a single sheet of package material is folded to form the gusset sections, there is a possibility that the folding positions will be displaced. In such a case, the displacement will accumulate and the side edges of the package material in the width direction of the package material will eventually be largely displaced from each other. Therefore, a dimensional allowance may be provided at each of the side portions of the package material in the width direction of the package material. Then, after the side portions of the package material in the width direction of the package material are bonded, redundant portions may be cut off. In such a case, an additional cutter for cutting the redundant portions is necessary.

The top gusset section is often formed in a hexagonal shape, and a cutting mechanism for cutting the top gusset section is generally provided. Therefore, as in the method for manufacturing the spouted pouch package according to the second aspect of the invention, the package material may be folded such that one of the side portions of the package material in the width direction of the package material forms a part of the peripheral edge of the top gusset section in the pouch. In such a case, the side portions of the package material in the width direction of the package material are bonded finally at the top gusset section. Therefore, the redundant portions at the side portions of the package material in the width direction of the package material may be cut when the top gusset section is cut in a predetermined shape. Thus, it is not necessary to use a dedicated cutter.

In addition, according to the method for manufacturing the spouted pouch package of the third aspect of the invention, in the process of heat-sealing the portions corresponding to the side edges of the body section to each other by the predetermined width, the portion of the package material corresponding to the top gusset section and the portion of the package material corresponding to the body section are heat-sealed by being clamped together between the sealing bars. Therefore, the boundaries between the top edge and the side edges of the body section, where sealing failure easily occurs, can be reliably heat-sealed and the sealing performance can be improved.

In addition, according to the method for manufacturing the spouted pouch package of the fourth aspect of the invention, after the portions corresponding to the side edges of the body section are heat-sealed to each other by the predetermined width, the portions corresponding to the boundaries between the top edge and the side edges of the body section are locally heat-sealed by clamping the portion of the package material corresponding to the top gusset section and the portion of the package material corresponding to the body section together between the sealing bars. Therefore, similar to the method for manufacturing the spouted pouch package according to the third aspect of the invention, the boundaries between the top edge and the side edges of the body section, where sealing failure easily occurs, can be reliably heat-sealed and the sealing performance can be improved.

DETAILED DESCRIPTION OF THE INVENTION

Figure 1:
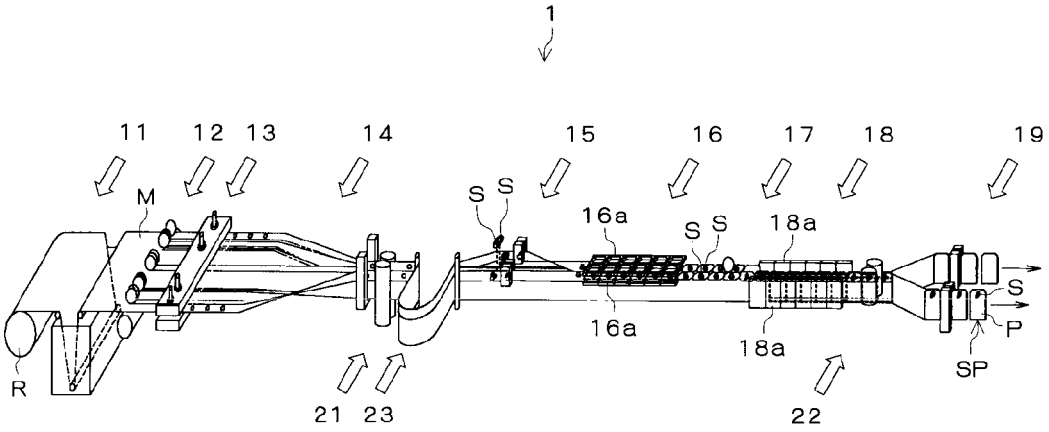
FIG. 1 is a schematic diagram illustrating a pouch-package manufacturing apparatus according to an embodiment which implements a method for manufacturing a spouted pouch package according to the present invention.

An embodiment will now be described with reference to the drawings. FIG. 1 is a schematic diagram illustrating a pouch-package manufacturing apparatus for manufacturing a spouted pouch package SP shown in FIGS. 12 and 13 in which a spout S is attached to a pouch P.

In the pouch-package manufacturing apparatus 1, spouted pouch packages SP are manufactured from a long band-shaped package material M, and both sides of the package material M in the width direction of the package material M across a center line are used. As shown in FIG. 1, the pouch-package manufacturing apparatus 1 includes a package-material conveying unit 11, a score-line forming unit 12, a hole-forming unit 13, a folding unit 14, a spout-attaching unit 15, a first sealing unit 16, a first cutting unit 17, a second sealing unit 18, and a second cutting unit 19. In the package-material conveying unit 11, the long band-shaped package material M, which is formed of a synthetic resin sheet, is pulled out from a package-material roll R obtained by winding the package material M in a roll-like shape, and is conveyed to the score-line forming unit 12. The score-line forming unit 12 forms score lines on the package material M. The hole-forming unit 13 forms spout attachment holes in areas corresponding to top gusset sections P2 of pouches P in the package material M on which the score lines are formed. The hole-forming unit 13 also forms cut-portion forming holes for forming cut portions c (see FIG. 13(*b*)) in areas corresponding to bottom gusset sections P3 of the pouches P. The folding unit 14 folds the package material M in the width direction of the package material M so that a conveying direction in which the package material M is conveyed is aligned with the width direction of the pouches P. The spout-attaching unit 15 attaches spouts S to the spout attachment holes H formed in the areas corresponding to the top gusset sections P2 in the package material M in the folded state. The first sealing unit 16 heat-seals a portion corresponding to the peripheral edge of the top gusset section P2 of each pouch P and a portion corresponding to the top edge of a body section P1 of each pouch P to each other by a predetermined width. The first cutting unit 17 cuts the package material M in the width direction of the package material M. The second sealing unit 18 heat-seals portions corresponding to side edges of the body section P1 of each pouch P to each other by a predetermined width, and also heat-seals a portion corresponding to the peripheral edge of the bottom gusset section P3 of each pouch P and a portion corresponding to the peripheral edge of a bottom end portion of the body section P1 of each pouch P to each other by a predetermined width. The second cutting unit cuts heat-sealed portions having a predetermined width formed at the portions corresponding to the side edges of the body section P1 of each pouch P, so that the spouted pouch packages SP are separated from each other.

A continuous conveying unit 21 which continuously conveys the folded package material M is disposed between the folding unit 14 and the spout-attaching unit 15. In addition, an intermittent conveying unit 22 which intermittently conveys the package material M is disposed between the second sealing unit 18 and the second cutting unit 19. An accumulator section 23 is disposed between the continuous conveying unit 21 and the spout-attaching unit 15 and accumulates the folded package material conveyed by the continuous conveying unit 21 while the intermittent conveying unit 22 is in the stopped state.

Figure 2:
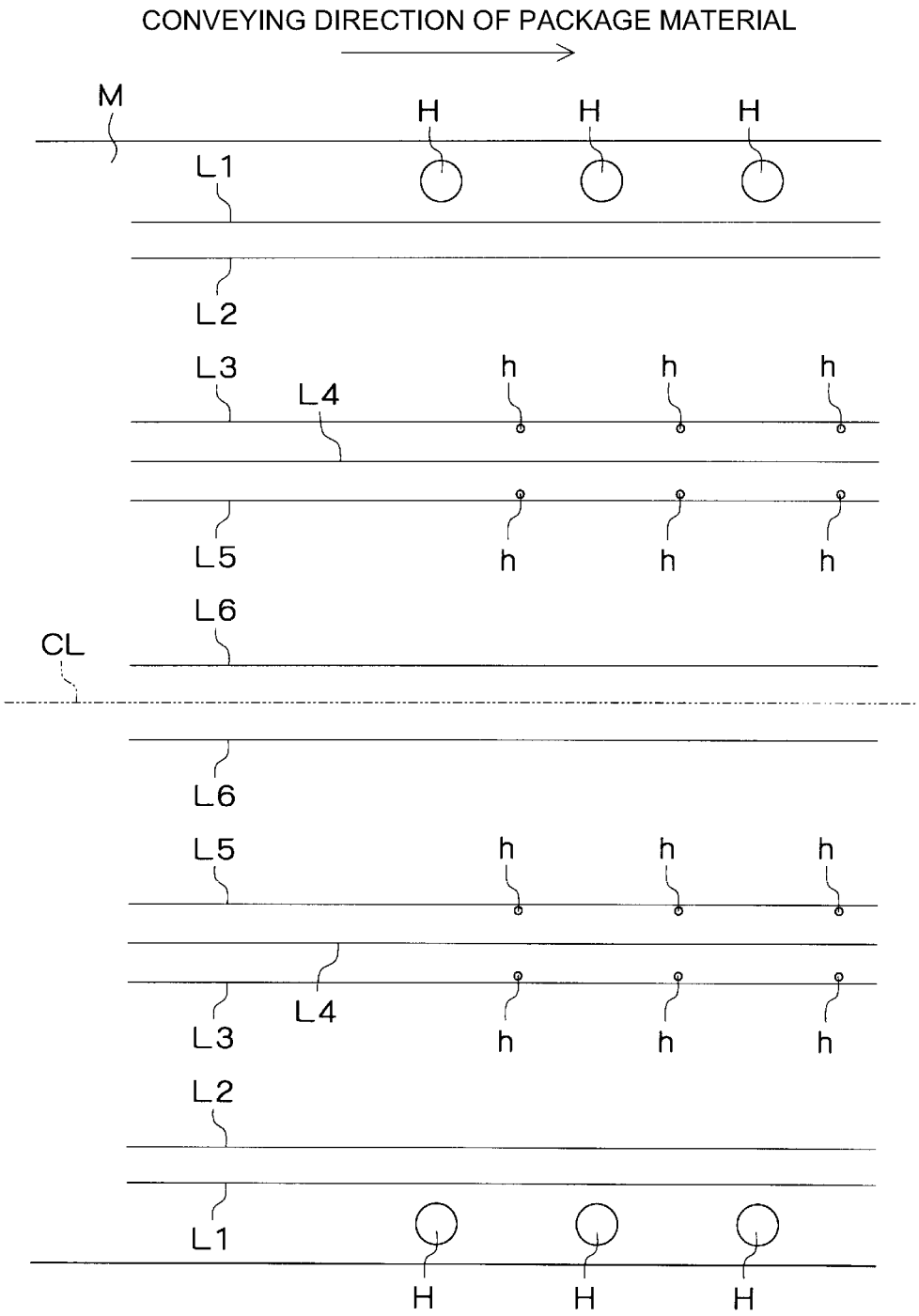
FIG. 2 is a diagram illustrating a score-line forming step and a hole forming step performed by the pouch-package manufacturing apparatus.

A process for manufacturing the spouted pouch packages SP using the above-described pouch-package manufacturing apparatus 1 will now be described. First, when the package material M is conveyed by the package-material conveying unit 11, the score-line forming unit 12 forms a plurality of score lines L1 to L6, as shown in FIG. 2. Then, the spout attachment holes H and the cut-portion forming holes h are successively formed by the hole-forming unit 13, as shown in FIG. 2. The score lines L1 to L6, the spout attachment holes H, and the cut-portion forming holes h are formed symmetrically about the center line CL of the package material M.

Figure 3:
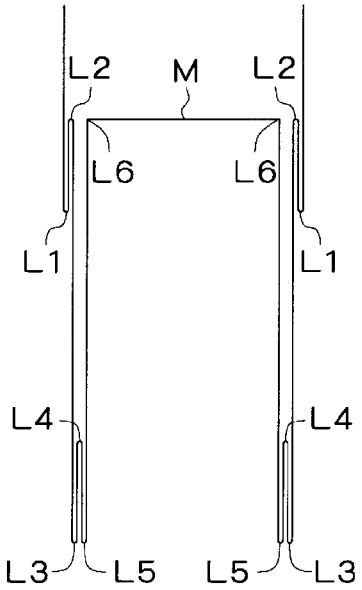
FIG. 3 is a diagram illustrating a folding step performed by the pouch-package manufacturing apparatus.

Then, the package material M on which the score lines L1 to L6 are formed and in which the spout attachment holes H and the cut-portion forming holes h are formed is conveyed to the folding unit 14, which folds the package material M in the width direction. As shown in FIG. 3, the package material M is folded along the score lines L1 to L6 such that portions corresponding to the body section P1, the top gusset section P2, and the bottom gusset section P3 are formed for each pouch P.

Figure 4:
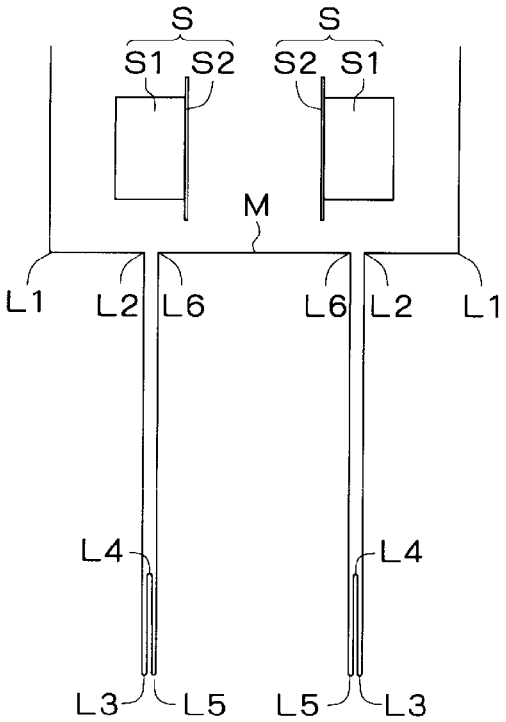
FIG. 4 is a diagram illustrating a spout attaching step performed by the pouch-package manufacturing apparatus.
Figure 5:
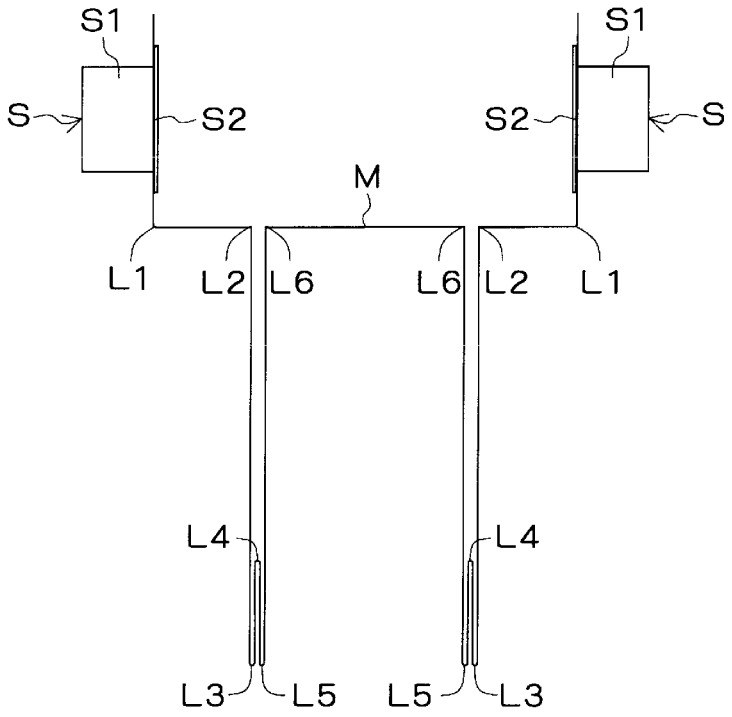
FIG. 5 is another diagram illustrating the spout attaching step performed by the pouch-package manufacturing apparatus.
Figure 6:
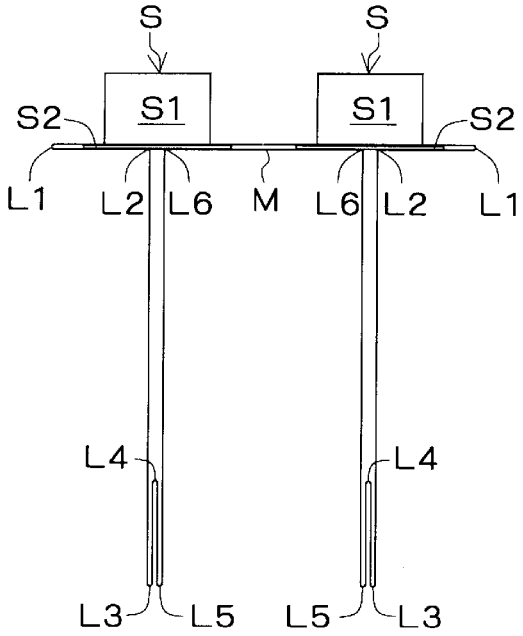
FIG. 6 is another diagram illustrating the spout attaching step performed by the pouch-package manufacturing apparatus.

Then, side portions of the thus-folded package material M are positioned as shown in FIG. 4 by the spout-attaching unit 15. Then, as shown in FIG. 5, main bodies S1 of the spouts S are inserted into the spout attachment holes H formed in the areas corresponding to the top gusset sections P2, and flange portions S2 of the spouts S are heat-sealed to portions of the top gusset sections P2 around the spout attachment holes H. Then, as shown in FIG. 6, portions corresponding to the top gusset sections P2 to which the spouts S are attached are folded onto a central portion of the package material in the width direction of the package material.

Figure 7:
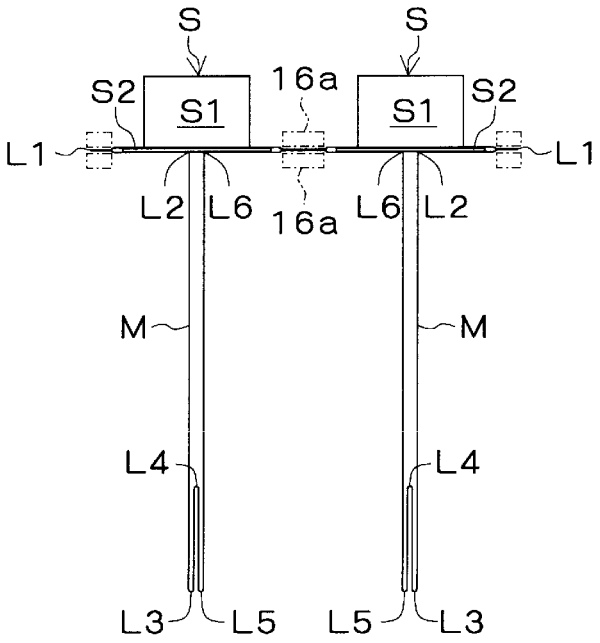
FIGS. 7(*a*) and (*b*) are diagrams illustrating a first sealing step performed by the pouch-package manufacturing apparatus.
Figure 7:
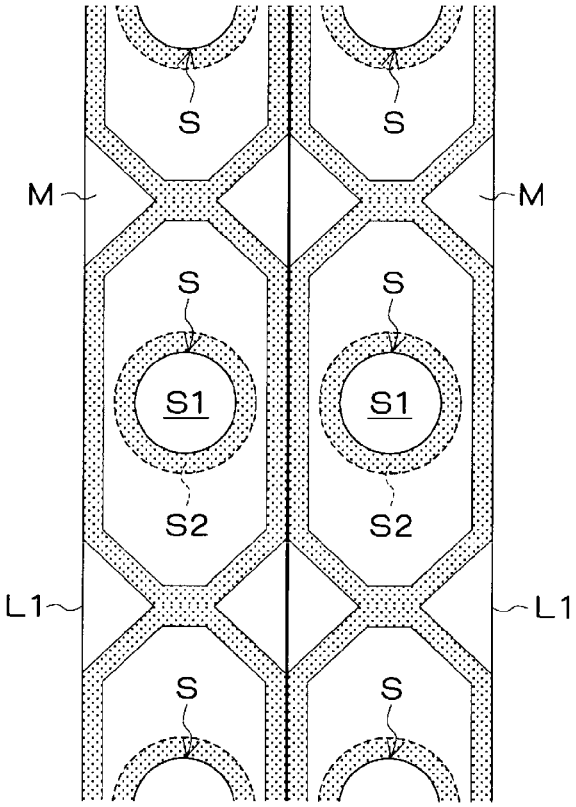
Figure 8:
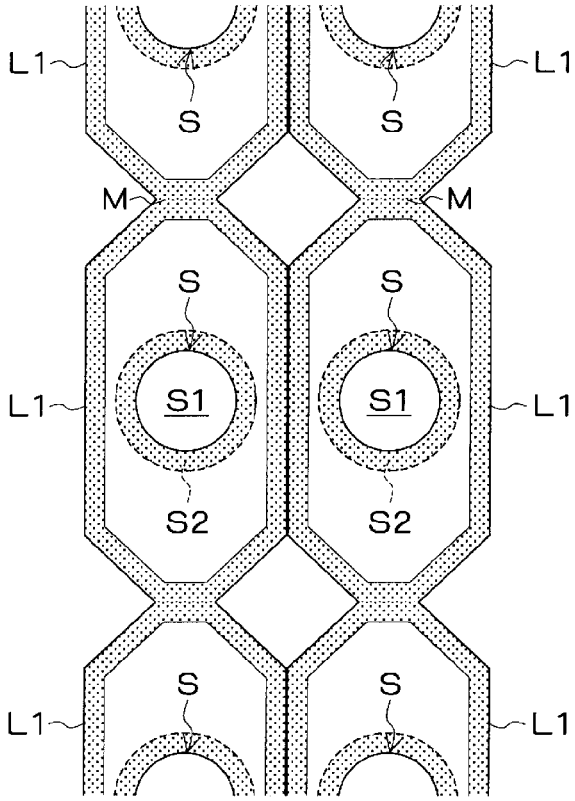
FIG. 8 is a diagram illustrating a step of cutting off unnecessary portions performed by the pouch-package manufacturing apparatus.

Then, in the first sealing unit 16, as shown in FIGS. 7(*a*) and 7(*b*), a portion corresponding to the peripheral edge of the top gusset section P2 of each pouch P and a portion corresponding to the top edge of the body section P1 of each pouch P are clamped between sealing members 16*a*, 16*a*, and are thereby heat-sealed to each other by a predetermined width in a substantially octagonal shape. Then, the heat-sealed portions are cooled. Then, as shown in FIG. 8, unnecessary portions are cut off so that the portions corresponding to the top gusset sections P2 have a substantially octagonal shape. In FIGS. 7(*b*) and 8, the shaded portions show the heat-sealed portions.

Figure 9:
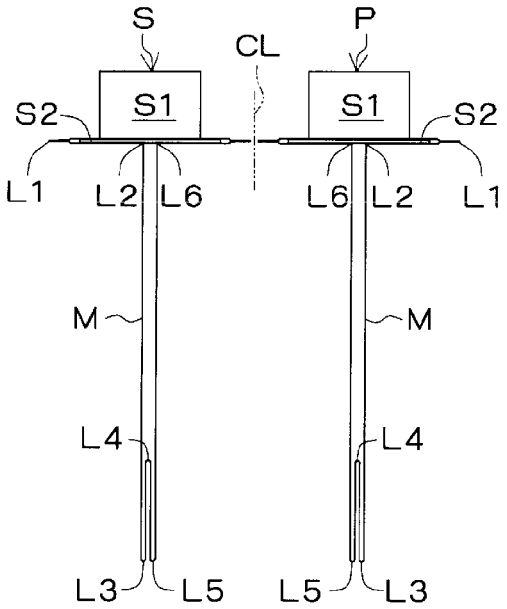
FIG. 9 is a diagram illustrating a first cutting step performed by the pouch-package manufacturing apparatus.
Figure 10:
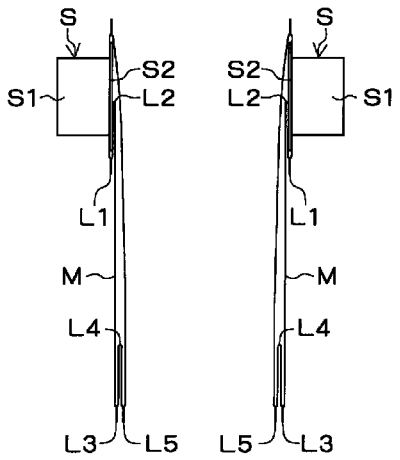
FIGS. 10(*a*) and (*b*) are diagrams illustrating a second sealing step performed by the pouch-package manufacturing apparatus.
Figure 10:
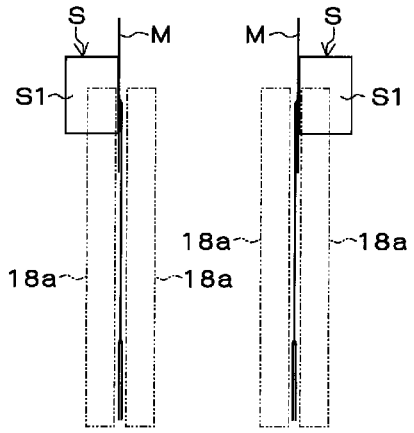
Figure 11:
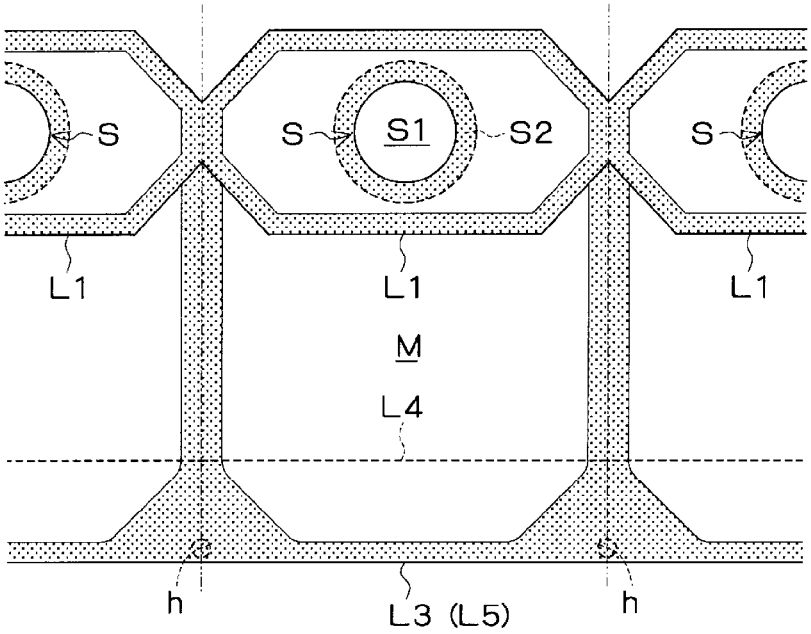
FIG. 11 is another diagram illustrating the second sealing step performed by the pouch-package manufacturing apparatus

Then, as shown in FIG. 9, the package material M is cut along the center line CL by the first cutting unit 17. Then, as shown in FIG. 10(*a*), the package material M is folded such that the portions corresponding to the top gusset sections P2 to which the spouts S are attached stand upright. Then, as shown in FIG. 10(*b*), portions including the folded portions are clamped between sealing members 18*a*, 18*a*, so that portions corresponding to side edges of the body section P1 of each pouch P are heat-sealed to each other by a predetermined width, as shown in FIG. 11, and a portion corresponding to the peripheral edge of the bottom gusset section P3 of each pouch P and a portion corresponding to the peripheral edge of a bottom end portion of the body section P1 of each pouch P are heat-sealed to each other. Then, the heat-sealed portions are cooled. In FIG. 11, the shaded portions show the heat-sealed portions.

Figure 12:
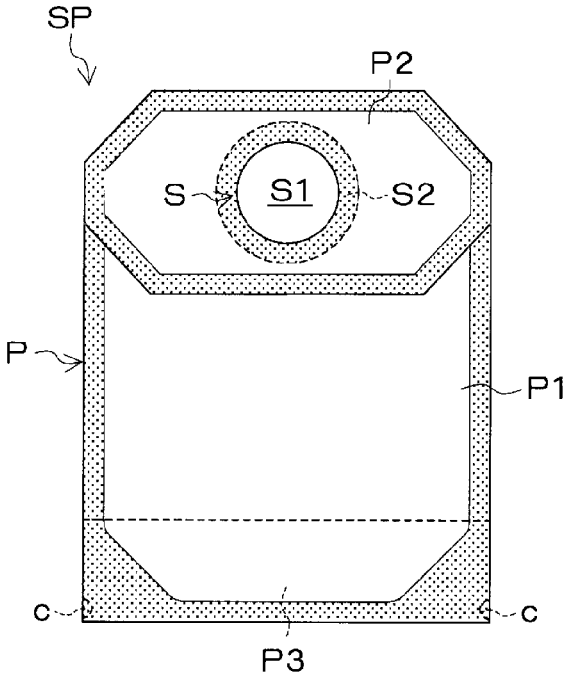
FIG. 12 is a front view of a spouted pouch package immediately after the spouted pouch package is manufactured by the pouch-package manufacturing apparatus.
Figure 13:
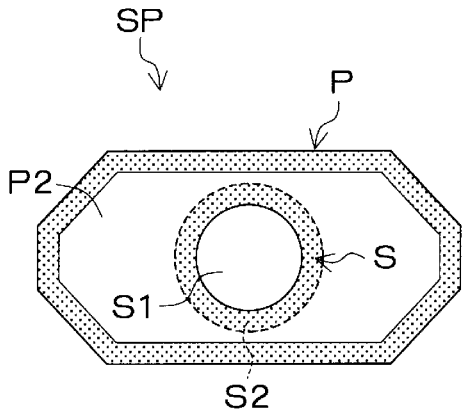
FIG. 13 (*a*) is a plan view of the spouted pouch package, FIG. 13(*b*) is a front view of the spouted pouch package, and FIG. 13(*c*) is a side view of the spouted pouch package.
Figure 13:
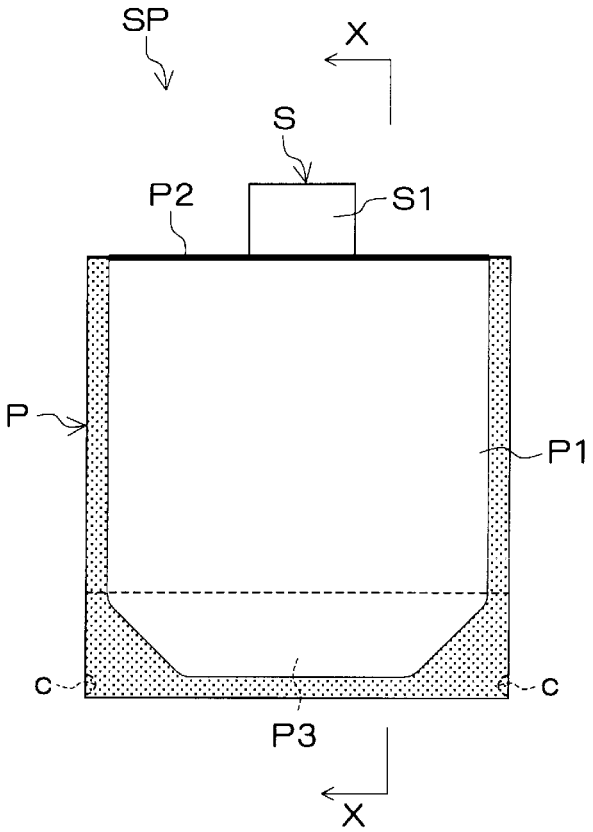
Figure 13:
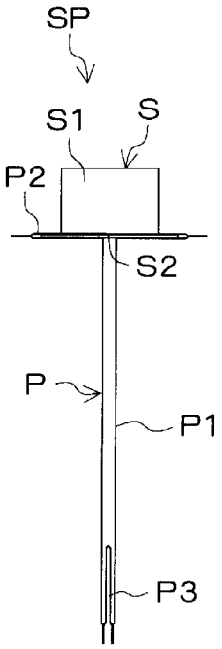
Figure 14:
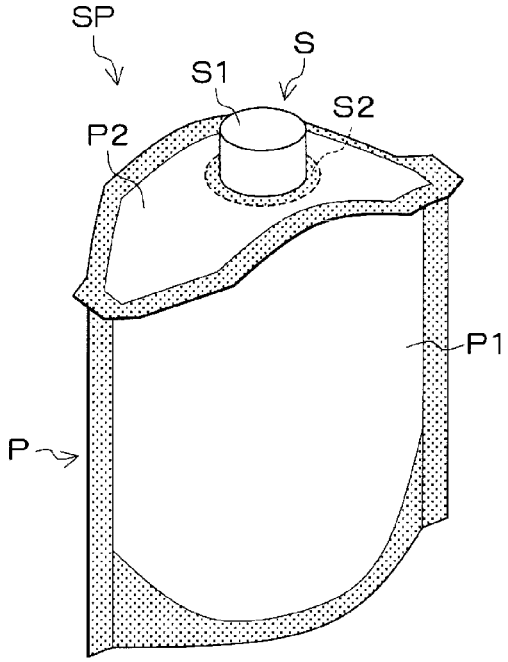
FIG. 14 is a perspective view illustrating the state in which the spouted pouch package is filled with content.

Lastly, the second cutting unit 19 cuts the heat-sealed portions having the predetermined width at the portions corresponding to the side edges of the body section P1 of each pouch P. The heat-sealed portions are cut along the dot-dash lines shown in FIG. 11. Accordingly, as shown in FIG. 12, each spouted pouch package SP is obtained in the state in which the pouch P is folded such that the top gusset section P2 faces the front. In FIG. 12, the shaded portions show the heat-sealed portions.

As described above, according to the pouch-package manufacturing apparatus 1, the bottom gusset spouted pouch package SP having the spout S attached to the top gusset section P2 can be efficiently mass-produced from a single sheet of package material M.

In addition, in the second sealing unit 18, when the portions corresponding to side edges of the body section P1 of each pouch P are heat-sealed to each other by a predetermined width, a portion corresponding to a top end portion of the body section P1 is folded such that the portion corresponding to the top gusset section P2 to which the spout S is attached stands upright. Then, the portion including the folded portion is clamped between the sealing bars. Therefore, the boundaries between the top edge and the side edges of the body section P1, where sealing failure easily occurs, can be reliably heat-sealed.

Figure 15:
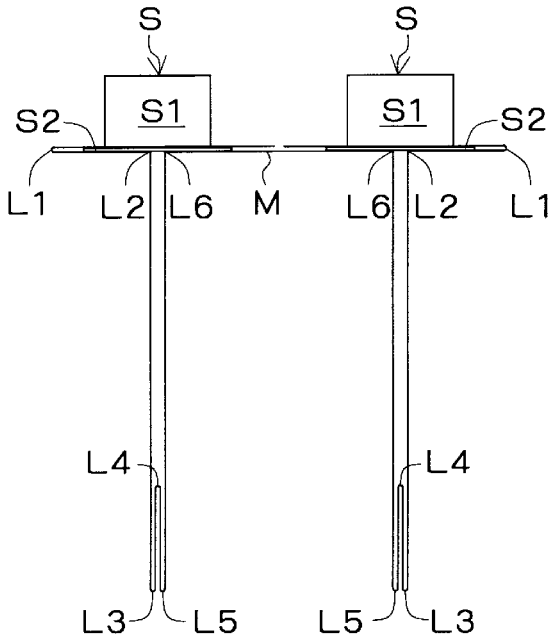
FIGS. 15(*a*) and (*b*) are diagrams illustrating a modification of a method for manufacturing a spouted pouch package performed by the pouch-package manufacturing apparatus.
Figure 15:
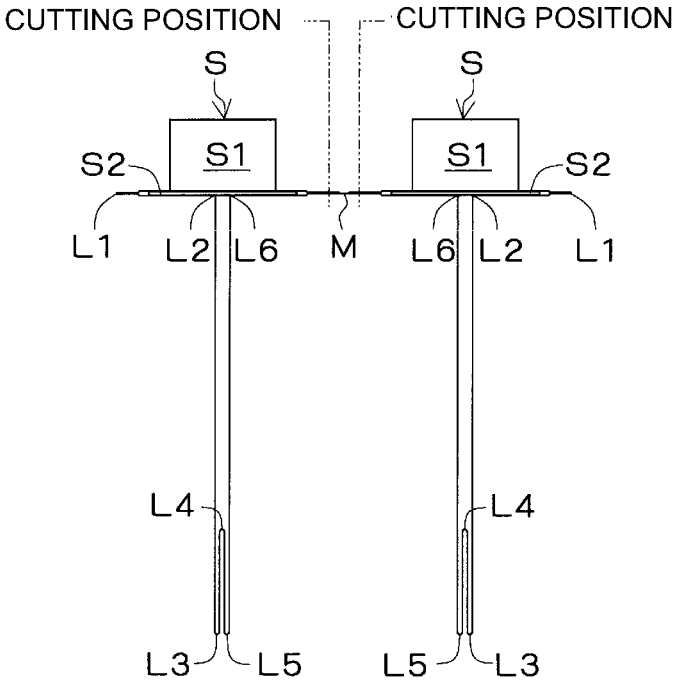

In the above-described embodiment, the distance between each of the side edges of the package material M and the score line L1 adjacent thereto and the distance between the score lines L6, L6 are regularly set so that the side edges of the package material M meet each other on the center line CL when the package material M is folded. However, in the case where a single sheet of package material M is folded to form the top gusset sections P2 and the bottom gusset sections P3, there is a possibility that the folding positions will be displaced in the manufacturing process. In such a case, the displacement will accumulate and the side edges of the package material M in the width direction of the package material M will eventually be largely displaced from each other instead of meeting with each other. Therefore, as shown in FIGS. 15(*a*) and 15(*b*), preferably, an allowance is provided in the distance between each of the side edges of the package material M and the score line L1 adjacent thereto and the distance between the score lines L6, L6, and redundant portions are cut off.

In this case, if the side portions of the package material M in the width direction of the package material M are bonded in the areas corresponding to the top gusset sections P2 of the pouches P, the redundant portions can be cut off in the process of cutting the package material M in the width direction with the first cutting unit 17. Therefore, it is not necessary to use a dedicated cutter.

In addition, in the above-described embodiment, the second cutting unit 19 separates the spouted pouch packages SP from each other immediately after the portions corresponding to the side edges of the body section P1 of each pouch P are heat-sealed to each other and the portion corresponding to the peripheral edge of the bottom gusset section P3 of each pouch P and the portion corresponding to the peripheral edge of the bottom end portion of the body section P1 of each pouch P are heat-sealed to each other by the second sealing unit 18. However, a third sealing unit in which only the portion corresponding to the top end portion of the body section P1 which is folded is clamped by sealing bars again and is locally heat-sealed may be provided between the second sealing unit 18 and the second cutting unit 19. In such a case, the boundaries between the top edge and the side edges of the body section P1, where sealing failure easily occurs, can be more reliably heat-sealed.

Figure 16:
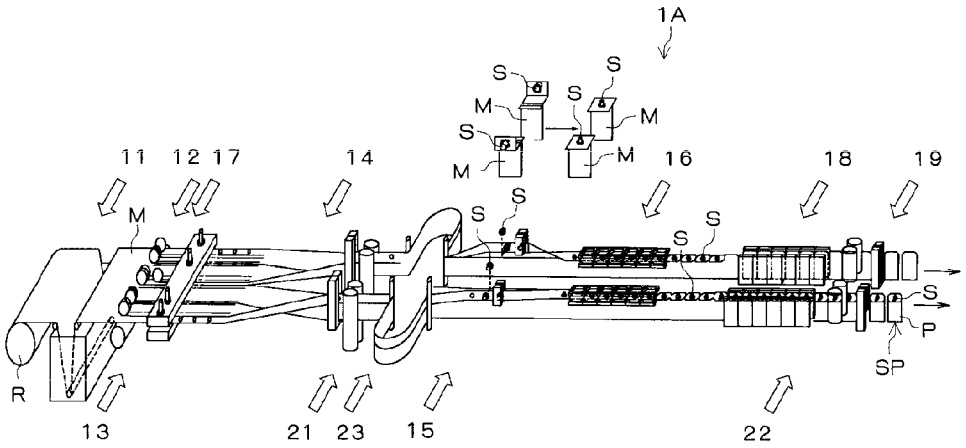
FIG. 16 is a schematic diagram illustrating a pouch-package manufacturing apparatus according to another embodiment which implements a method for manufacturing a spouted pouch package according to the present invention.

In addition, in the above-described pouch-package manufacturing apparatus 1, the first cutting unit 17 which cuts the package material M in the width direction of the package material M is disposed between the first sealing unit and the second sealing unit 18. However, the present invention is not limited to this, and the first cutting unit may also be disposed between the score-line forming unit 12 and the hole-forming unit 13, as in a pouch-package manufacturing apparatus 1A shown in FIG. 16. In this case, as shown in FIG. 16, pairs of folding units 14, spout-attaching units 15, first sealing units 16, second sealing units 18, second cutting units 19, continuous conveying units 21, intermittent conveying units 22, and accumulator sections 23 must be provided.

Figure 17:
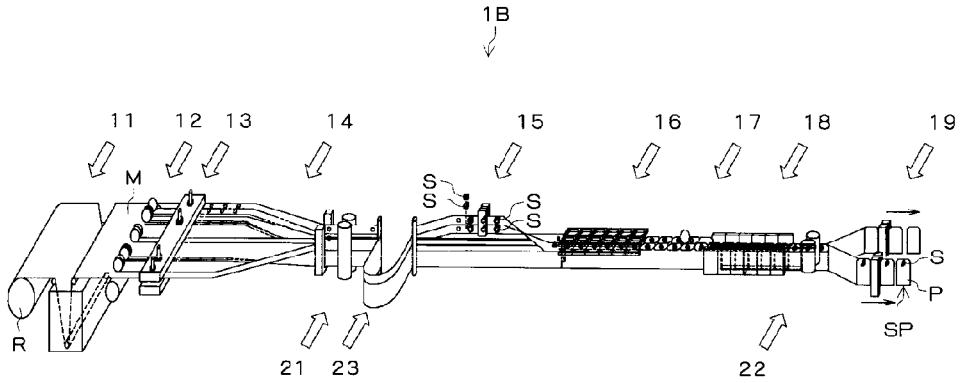
FIG. 17 is a schematic diagram illustrating a pouch-package manufacturing apparatus according to another embodiment which implements a method for manufacturing a spouted pouch package according to the present invention.
Figure 18:
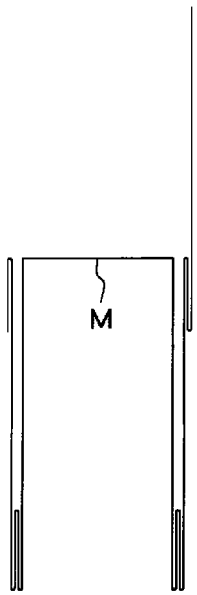
FIGS. 18(*a*) to (*c*) are diagrams illustrating a folding step and a spout-attaching step performed by the pouch-package manufacturing apparatus.
Figure 18:
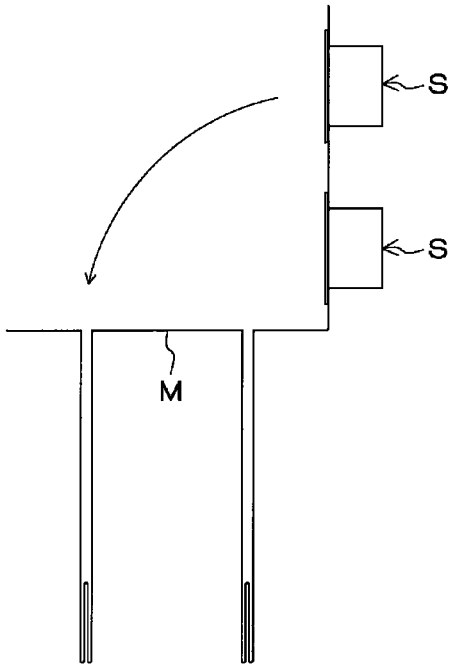
Figure 18:
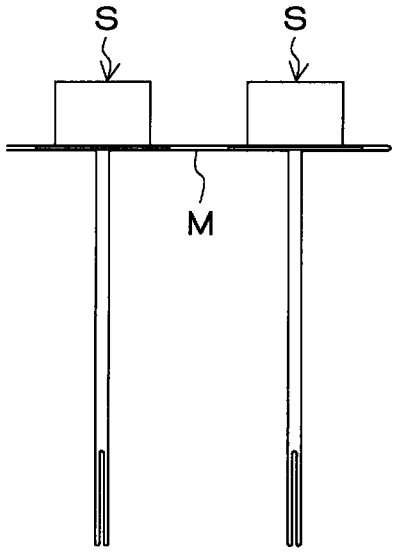

In addition, in the above-described pouch-package manufacturing apparatus 1, the package material M is folded such that the side edges of the package material M meet each other on the center line CL. In other words, portions corresponding to the top gusset sections P2 of the pouches P are positioned at the side edges of the package material M. However, the present invention is not limited to this. For example, as in a pouch-package manufacturing apparatus 1B shown in FIG. 17, portions corresponding to the top gusset sections P2 of the pouches P may be disposed at one side of the package material M, and the package material M may be folded by the folding unit 14 as shown in FIG. 18(*a*). In this case, the spout-attaching unit 15 positions the side portion of the package material M as shown in FIG. 18(*b*), and then attaches two spouts S to the side portion. Then, the portion corresponding to the top gusset sections P2 to which the spouts S are attached is folded as shown in FIG. 18(*c*).

In addition, in each of the above-described embodiments, the sealing performance at the boundaries between the top edge and the side edges of the body section P1 of each pouch P, where sealing failure easily occurs, is increased by the following method. That is, in the second sealing unit 18, when the portions corresponding to the side edges of the body section P1 of each pouch P are heat-sealed to each other by a predetermined width, the portion corresponding to the top end portion of the body section P1 is folded such that the portion corresponding to the top gusset section P2 to which the spout S is attached stands upright. Then, the portion including the folded portion is clamped between the sealing members 18*a*. However, the present invention is not limited to this, and the sealing performance at the boundaries between the top edge and the side edges of the body section P1 of each pouch P, where sealing failure easily occurs, may also be increased by the following method. That is, first, only the portions corresponding to the side edges of the body section P1 of each pouch P are heat-sealed to each other by a predetermined width. Then, before the package material M is cut by the second cutting unit 19, the portion corresponding to the top end portion of the body section P1 is folded such that the portion corresponding to the top gusset section P2 to which the spout S is attached stands upright. Then, only the folded portion is clamped between sealing bars again and may be locally heat-sealed.

Figure 19:
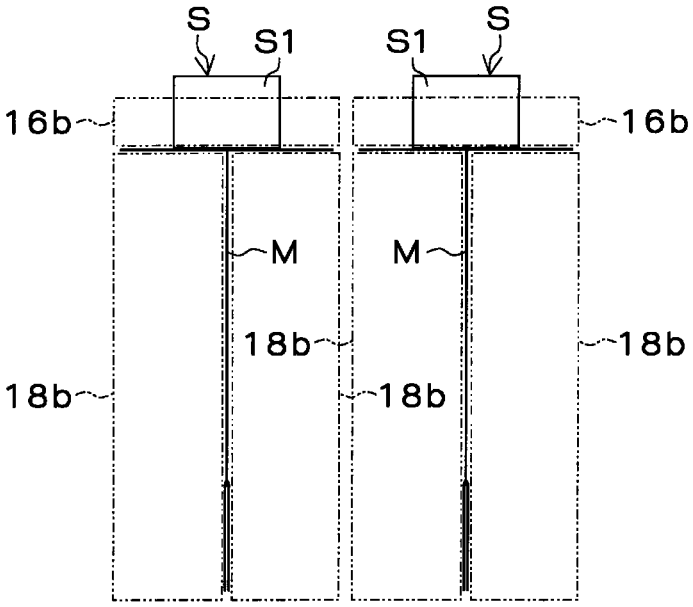
FIG. 19 is a diagram illustrating a modification of the method for manufacturing a spouted pouch package.

In this case, as shown in FIG. 19, the first sealing step and the second sealing step may be simultaneously performed. More specifically, the sealing members 16*b*, 18*b* may be used to clamp the portion corresponding to the peripheral edge of the top gusset section P2 of each pouch P and the portion corresponding to the top edge of the body section P1 of each pouch P, to clamp the portions corresponding to the side edges of the body section P1 of each pouch P, and to clamp the portion corresponding to the peripheral edge of the bottom gusset section P3 of each pouch P and the portion corresponding to the peripheral edge of the bottom end portion of the body section P1 of each pouch P.

In addition, in each of the above-described embodiments, two spouted pouch packages SP are simultaneously manufactured from a single sheet of package material M. However, the present invention is not limited to this, and may, of course, also be applied to the case in which three or more spouted pouch packages SP are simultaneously manufactured or the case in which the single spouted pouch packages SP are manufactured one at a time from a single package material M.

The present invention can be applied to the case where a bottom gusset spouted pouch package in which a spout is attached to a top gusset section is mass-produced.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. An apparatus for manufacturing a spouted pouch package including a pouch and a spout, the pouch including a body section which is heat-sealed at side edges thereof, a top gusset section provided on a top end portion of the body section, and a bottom gusset section provided on a bottom end portion of the body section, the spout being attached to the top gusset section of the pouch, the apparatus comprising:

a folding unit which folds a long package material while conveying the package material, the package material being folded in a width direction of the package material such that a conveying direction in which the package material is conveyed is aligned with a width direction of the pouch;

a spout-attaching unit which attaches the spout to a portion of the folded package material which corresponds to the top gusset section with the spout being attached to a portion separate from and in between the heat-sealed side edges extending along lateral sides of the top gusset section, of the top gusset section of the pouch;

a first sealing unit including sealing bars which heat-seal a portion of the folded package corresponding to a peripheral edge of the top gusset section and a portion of the folded package corresponding to a top edge of the body section each other;

a second sealing unit including sealing bars which heat-seal portions of the folded package corresponding to side edges of the body section to each other and heat-seals a portion of the folded package corresponding to a peripheral edge of the bottom gusset section and a portion of the folded package corresponding to a peripheral edge of the bottom end portion of the body section to each other;

a cutting unit which cuts the heat-sealed portions formed at the portions corresponding to the side edges of the body section, thereby releasing the spouted pouch package;

wherein a conveying unit is configured to convey the package material to said folding unit, then to said spout-attaching unit, then to said first and second sealing units, and then to said cutting unit;

wherein said long package material is a single elongated sheet having substantially parallel lateral side edges, and wherein said spout-attaching unit attaches a spout for a spouted package adjacent a first of said lateral side edges and distal to the other of said lateral side edges, and wherein after attachment of said spout said first sealing unit heat seals said package material along said first lateral side edge to form an enclosed tubular shape from said single elongated sheet;

wherein said folding unit is configured to fold said package material such that said package material has an extending side portion along said first lateral side edge for receiving said spouts, said extending side portion forming an entire top gusset section of a spouted package to be formed, said package material extending downward from said extending side portion to a bottom end corresponding to a bottom of a pouch package to be formed and extending upwardly again to an opposite top end corresponding to a height of said extending side portion; and wherein said spout-attaching unit is configured to attach said spouts to said extending side portion while said package material is conveyed in a substantially horizontal direction and said first sealing unit is configured to seal said package material while said package material is conveyed in a substantially horizontal direction.

2. The apparatus for manufacturing the spouted pouch package according to claim 1, wherein said folding unit folds the package material in a way such that a side edge portion of the package material in the width direction of the package material forms a part of the peripheral edge of the top gusset section in the pouch.

3. The apparatus for manufacturing the spouted pouch package according to claim 2, wherein said first heat-sealing unit and said second heat-sealing unit are configured to simultaneously heat-seal said pouch, and wherein the conveying unit is configured to convey the package material to the first and second sealing units after the spout-attaching unit and before the cutting unit.

4. The apparatus for manufacturing the spouted pouch package according to claim 2, further comprising:

a third sealing unit including local sealing bars which locally heat-seal portions corresponding to boundaries between the top edge of the body portion and the side edges of the body section by clamping a part of the portion of the folded package material corresponding to the top gusset section and a part of the portion of the folded package material corresponding to the side edges of the body section together between the local sealing bars, while a portion of the body section which corresponds to the top edge portion of the body section heat-sealed to the peripheral edge of the top gusset section on one side of the body section is folded downward, wherein said third sealing unit is configured to locally heat-seal the boundaries after said second heat sealing unit heat-seals the portions corresponding to the side edges of the body section, wherein said third sealing unit is configured to locally heat seal the boundaries before said cutting unit cuts the heat-sealed portions, and wherein the conveying unit is configured to convey the package material to the third sealing unit after the second sealing unit and before the cutting unit.

5. The apparatus for manufacturing the spouted pouch package according to claim 2, wherein said second heat-sealing unit is configured to heat-seal said pouch after said first heat-sealing unit heat-seals the pouch, and after said the portion of the body section which corresponds to the top edge portion of the body section heat-sealed to the peripheral edge of the top gusset section on one side of the body section is folded downward, such that portions corresponding to boundaries between the top edge and the side edges of the body section are heat-sealed a second time, and wherein the conveying unit is configured to convey the package material to the second sealing unit after the first sealing unit and before the cutting unit.

6. The apparatus for manufacturing the spouted pouch package according to claim 2, wherein said first heat-sealing unit and said second heat-sealing unit are configured to simultaneously heat-seal said pouch, wherein the conveying unit is configured to convey the package material to the first and second sealing units after the spout-attaching unit and before the cutting unit; and wherein said first sealing unit and said second sealing unit seal said folded package with said folded package in a T-shape state with said top gusset section and said side edge portion of the folded package corresponding to the top edge of the body section forming a top of said T-shape.

7. The apparatus for manufacturing the spouted pouch package according to claim 1, further comprising:

a third sealing unit including local sealing bars which locally heat-seal portions corresponding to boundaries between the top edge of the body portion and the side edges of the body section by clamping a part of the portion of the folded package material corresponding to the top gusset section and a part of the portion of the folded package material corresponding to the side edges of the body section together between the local sealing bars, while a portion of the body section which corresponds to the top edge portion of the body section heat-sealed to the peripheral edge of the top gusset section on one side of the body section is folded downward, wherein said third sealing unit is configured to locally heat-seal the boundaries after said second heat sealing unit heat-seals the portions corresponding to the side edges of the body section, wherein said third sealing unit is configured to locally heat seal the boundaries before said cutting unit cuts the heat-sealed portions, and wherein the conveying unit is configured to convey the package material to the third sealing unit after the second sealing unit and before the cutting unit.

8. The apparatus for manufacturing the spouted pouch package according to claim 1, wherein said second heat-sealing unit is configured to heat-seal said pouch after said first heat-sealing unit heat-seals the pouch, and after said the portion of the body section which corresponds to the top edge portion of the body section heat-sealed to the peripheral edge of the top gusset section on one side of the body section is folded downward, such that portions corresponding to boundaries between the top edge and the side edges of the body section are heat-sealed a second time, and wherein the conveying unit is configured to convey the package material to the second sealing unit after the first sealing unit and before the cutting unit.

9. The apparatus for manufacturing the spouted pouch package according to claim 1, wherein said spout-attaching unit attaches the spout to a central area of said top gusset section and not to said heat-sealed side edges.

10. The apparatus for manufacturing the spouted pouch package according to claim 9, wherein said folding unit folds the package material in a way such that a side edge portion of the package material in the width direction of the package material forms a part of the peripheral edge of the top gusset section in the pouch.

11. The apparatus for manufacturing the spouted pouch package according to claim 9, wherein said folding unit is configured to fold said single elongated sheet of package material while conveying said single elongated sheet of package material, the single elongated sheet of package material being folded in a width direction of the single elongated sheet of package material such that a conveying direction in which the long single sheet package material is conveyed is aligned with a width direction of the pouch, wherein said pouch is formed with only said single elongated sheet of packaging material.

12. The apparatus for manufacturing the spouted pouch package according to claim 1, further including a hole-forming unit which forms spout attachment holes in the packaging material in an area corresponding to the top gusset section prior to attaching of spouts by said spout-attaching unit, and wherein said spout-attaching unit attaches said spouts within said spout attachment holes.

13. The apparatus for manufacturing the spouted pouch package according to claim 1, wherein said first sealing unit seals said folded package with said folded package in a T-shape state with said top gusset section and said portion of the folded package corresponding to the top edge of the body section forming a top of said T-shape.

14. The apparatus for manufacturing the spouted pouch package according to claim 1, wherein said folding unit is configured to fold said single elongated sheet of package material while conveying said single elongated sheet of package material, the single elongated sheet of package material being folded in a width direction of the single elongated sheet of package material such that a conveying direction in which the long single sheet package material is conveyed is aligned with a width direction of the pouch, wherein said pouch is formed with only said single elongated sheet of packaging material.

15. The apparatus for manufacturing the spouted pouch package according to claim 1, further including a score-line forming unit located prior to said folding unit that is configured to form score lines on the package material extending in the conveying direction of the package material.

16. The apparatus for manufacturing the spouted pouch according to claim 1, wherein said first sealing unit is located horizontally displaced downstream along said conveying direction from said spout attaching unit and said spout attaching unit is located horizontally displaced downstream along said conveying direction from said folding unit.

17. The apparatus for manufacturing the spouted pouch package according to claim 16, further including a score-line forming unit located horizontally displaced upstream along said conveying direction prior to said folding unit that is configured to form score lines on the package material extending in the conveying direction of the package material.

18. The apparatus for manufacturing the spouted pouch package according to claim 1, wherein said extending side portion extends substantially vertically upwardly, wherein said spouts include flange portions, and wherein said apparatus is configured to heat-seal said flange portions of said spouts to said substantially vertically upwardly extending side portion while extending substantially vertically upwardly.

19. The apparatus for manufacturing the spouted pouch package according to claim 18, wherein said apparatus is configured to fold said substantially vertical upwardly extending side portion downward such as to extend substantially horizontally with a distal end of thereof contacting said opposite top end prior to sealing by said first and second sealing units.

20. An apparatus for manufacturing a spouted pouch package including a pouch and a spout, the pouch including a body section which is heat-sealed at side edges thereof, a top gusset section provided on a top end portion of the body section, and a bottom gusset section provided on a bottom end portion of the body section, the spout being attached to the top gusset section of the pouch, the apparatus comprising:

a folding unit which folds a long package material while conveying the package material, the package material being folded in a width direction of the package material such that a conveying direction in which the package material is conveyed is aligned with a width direction of the pouch, wherein said long packaging material includes a spout mounting hole formed within the top gusset section;

a spout-attaching unit which attaches the spout in the spout mounting hole formed in the top gusset section with the spout being attached to a portion, other than the heat-sealed peripheral edges, of the top gusset section of the pouch;

a first sealing unit including sealing bars which heat-seal a portion of the folded package corresponding to a peripheral edge of the top gusset section and a portion of the folded package corresponding to a top edge of the body section each other;

a second sealing unit including sealing bars which heat-seal portions of the folded package corresponding to side edges of the body section to each other and heat-seals a portion of the folded package corresponding to a peripheral edge of the bottom gusset section and a portion of the folded package corresponding to a peripheral edge of the bottom end portion of the body section to each other;

a cutting unit which cuts the heat-sealed portions formed at the portions corresponding to the side edges of the body section, thereby releasing the spouted pouch package;

wherein a conveying unit is configured to convey the package material to said folding unit, then to said spout-attaching unit, then to said first and second sealing units, and then to said cutting unit;

wherein said long package material is a single elongated sheet having substantially parallel lateral side edges, and wherein said spout-attaching unit attaches a spout for a spouted package adjacent a first of said lateral side edges and distal to the other of said lateral side edges, and wherein after attachment of said spout said first sealing unit heat seals said package material along said first lateral side edge to form an enclosed tubular shape from said single elongated sheet;

wherein said folding unit is configured to fold said package material such that said package material has an extending side portion along said first lateral side edge for receiving said spouts, said extending side portion forming an entire top gusset section of a spouted package to be formed, said package material extending downward from said extending side portion to a bottom end corresponding to a bottom of a pouch package to be formed and extending upwardly again to an opposite top end corresponding to a height of said extending side portion; and wherein said spout-attaching unit is configured to attach said spouts to said extending side portion while said package material is conveyed in a substantially horizontal direction and said first sealing unit is configured to seal said package material while said package material is conveyed in a substantially horizontal direction.

21. The apparatus for manufacturing the spouted pouch package according to claim 20, wherein said spout-attaching unit attaches the spout to a central area of said top gusset section and not to said heat-sealed peripheral edges.

22. The apparatus for manufacturing the spouted pouch according to claim 20, further including that said a folding unit is configured to fold a single sheet of said long package material to form a plurality of adjacent rows of pouches, and wherein said spout-attaching unit attaches spouts in parallel rows of holes formed in said single sheet corresponding to said plurality of adjacent rows of pouches.

* * * * *